US006971477B2

(12) United States Patent
Wyse

(10) Patent No.: US 6,971,477 B2
(45) Date of Patent: Dec. 6, 2005

(54) WALKBOARD LEDGER FOR SCAFFOLDING

(76) Inventor: Steven J. Wyse, 82 Pin Oak, Archbold, OH (US) 42502

( * ) Notice: Subject to any disclaimer, the term of this patent is extended or adjusted under 35 U.S.C. 154(b) by 0 days.

(21) Appl. No.: 10/950,113

(22) Filed: Sep. 24, 2004

(65) Prior Publication Data

US 2005/0034922 A1 Feb. 17, 2005

Related U.S. Application Data

(63) Continuation of application No. 10/065,760, filed on Nov. 15, 2002.

(51) Int. Cl.[7] ..... E04G 1/16
(52) U.S. Cl. ..... 182/119; 182/222
(58) Field of Search ..... 182/119, 222, 223, 182/178.1

(56) References Cited

U.S. PATENT DOCUMENTS 1,841,676 A * 1/1932 Roberts ..... 182/183.1
2,706,662 A * 4/1955 Brown ..... 182/113
4,596,096 A * 6/1986 Heath ..... 52/6
6,223,856 B1 * 5/2001 Schwoerer ..... 182/178.1

FOREIGN PATENT DOCUMENTS

EP 14155 A1 * 8/1980 ..... E04G 1/15

* cited by examiner

*Primary Examiner*—Alvin Chin-Shue
(74) *Attorney, Agent, or Firm*—Hovey Williams LLP

(57) ABSTRACT

A scaffolding (10) for elevating a worker (not shown) above a floor or ground surface is disclosed. The scaffolding (10) broadly includes a pair of frames (12) and (14), cross bracing (16) coupling the frames (12,14) together, and a plurality of walkboards (18, 20, and 22) removably supported between the frames (12,14). Each of the frames (12,14) includes a plurality of slotted ledgers (32, 34, 36, 38) and (40, 42, 44, 46) coupled to and extending horizontally between corresponding support posts (24,26) and (28,30), respectively. Each ledger is configured to facilitate initial assembly of the frames (12,14) and to prevent undesired shifting of a walkboard supported thereon. For example, the ledger (38) is defined by a U-shaped wall (60) that presents an arcuate walkboard bearing support surface (62) having open, recessed slots (64,66,68,70,72) defined therein. Each slot is configured and dimensioned to receive a portion of the supported walkboard and prevent shifting of the walkboard along the ledger axis.

20 Claims, 3 Drawing Sheets

26
72
70
20
68
108
108a
66
104
106
106a
84
64
86
24
62
60c
88
60b
38
18
110
104
108
60c
60
60b
A
116a
116
74
78
80
108a
54
82
120
22
36
122
112a
76
60a
7

WALKBOARD LEDGER FOR SCAFFOLDING

RELATED APPLICATIONS

This is a continuation of application Ser. No. 10/065,760 filed Nov. 15, 2002, which is hereby incorporated by reference herein.

BACKGROUND OF THE INVENTION

1. Field of the Invention

The present invention relates generally to scaffolding for supporting a worker elevated above the ground. More specifically, the present invention concerns a walkboard ledger for scaffolding that better prevents undesired shifting of a walkboard supported on the ledger and is easier to incorporate into the scaffolding than the prior art ledgers. The inventive ledger provides a positive nonslip removable coupling of the walkboard and the ledger that prevents unsafe and inadvertent shifting of the walkboard along the ledger when pressure is applied to the walkboard by the worker.

2. Discussion of Prior Art

It is known in the art to utilize scaffolding to provide an elevated walkboard to elevate a worker above a floor or ground surface to complete a task (e.g., painting, drywall finishing, etc.). The walkboard typically consists of one or more planks having a relatively flat supporting surface. The planks can be formed of a variety of materials including wood (e.g., 2'×10' lumber, etc.) or metal (e.g., aluminum, etc.). The scaffolding utilized to provide the elevated walkboard is often adjustable so that the elevation of the walkboard can be quickly and easily modified. For example, it is known in the art to provide the scaffolding with a plurality of ledgers positioned at various elevations, with each ledger configured to support one or more walkboard at the corresponding elevation. The ledgers are typically round tubes that also function as steps or rungs for use by the worker. The walkboard is typically not fastened to the ledgers to enable the walkboard to be readily movable between ledgers in order to adjust the elevation of the walkboard. For example, when a wood plank is used, the plank is typically simply laid across the ledger. Prior art metal planks sometimes include sidewalls with cut outs configured to fit around the ledger. In addition, the ledger is commonly wider than the width of a single walkboard to enable multiple walkboards to be placed on a single ledger and to enable a single walkboard to be adjustably positioned along a ledger. In some applications, it is desirable to support multiple walkboards at differing elevations (e.g., in a step-like arrangement) on a single scaffolding system. In these instances, the walkboards are typically offset to facilitate the worker moving from walkboard to walkboard. It is further known in the art to utilize a system of modular scaffolding to support a series of walkboards for elevating the worker or workers along a greater work area. When utilizing a series of walkboards spanning between two or more modules, it is sometimes desirable to support successive walkboards at a different elevation (e.g., when using a walkboard to span between adjacent scaffolding units, etc.). In all of these applications, serious safety concerns arise when the walkboard undesirably shifts along the ledger under the weight of the worker. Therefore, it is desirable to prevent the walkboard from shifting along the ledger yet still enable quick and easy removal and repositioning of the walkboard.

It is known in the art to provide a series of indentations along the top surface of a round ledger to inhibit shifting of the walkboard along the ledger. One such prior art ledger is illustrated in FIG. 1. The indentations are formed by crimping the cylindrical ledger at intervals that are spaced apart to correspond to the width of the sidewalls of standard metal walkboards. The sidewalls ride in the indentations to inhibit shifting of the walkboard along the ledger. In addition, the ends of the tubular ledger are crimped together to form a more linear surface to facilitate welding the ledger to support posts of the scaffolding.

These prior art ledgers are problematic and have several undesirable limitations. For example, the prior art ledgers do not adequately prevent undesired shifting of the walkboard along the ledger when the worker is supported thereon. In the prior art ledgers, when a worker exerts pressure on the walkboard (e.g, stepping onto the edge of the walkboard), this pressure often times causes the opposing edge of the walkboard to shift up the sloped edge of the indentation, allowing the walkboard to freely and undesirably shift along the ledger. Furthermore, the prior art ledgers do not enable any shift prevention of wooden planks. That is to say, wooden planks typically do not have sidewalls extending down for receipt into the indentations and common anchoring means (e.g., nails, bolts, etc.) are incompatible with the crimped indentations. Furthermore, the prior art ledgers are difficult to incorporate into the scaffolding. For example, the linear crimped edges of the tubular ledgers are difficult to couple to round support posts by welding. In addition, when the prior art ledgers are painted during manufacture (as is desirable in the art) or become exposed to other semi-liquid type residue during use (e.g., paint, putty, etc.), the sealed nature of the indentations collects the residue and thus further inhibits any shift prevention function of the indentations.

SUMMARY OF THE INVENTION

The present invention provides an improved ledger for scaffolding that does not suffer from the problems and limitations of the prior art ledgers detailed above. The inventive ledger provides a positive nonslip removable coupling of a walkboard and the ledger that prevents unsafe and inadvertent shifting of the walkboard along the ledger when pressure is applied to the walkboard by a worker. The inventive ledger includes an improved configuration that facilitates incorporating the ledger into the scaffolding and enables and maintains shift-prevention for virtually all types of walkboards.

A first aspect of the present invention concerns scaffolding for supporting a worker elevated above the ground. The scaffolding broadly includes a walkboard presenting a support surface on which the worker may be supported, and a scaffold frame configured to support the walkboard above the ground. The walkboard includes a coupling element projecting downwardly relative to the support surface. The frame includes a pair of spaced apart upright support posts and a ledger coupled to the support posts and extending therebetween to define a longitudinal ledger axis. The ledger includes an outer wall that presents an upper walkboard bearing surface extending along the ledger axis, with the walkboard being supported on the bearing surface. The ledger further presents a plurality of open slots defined in the bearing surface at points spaced along the ledger axis, with each of the slots extending entirely through the outer wall. A first one of the slots receives the coupling element therein to generally prevent the walkboard from shifting along the ledger axis.

A second aspect of the present invention concerns scaffolding for supporting a worker elevated above the ground. The scaffolding broadly includes a walkboard presenting a support surface on which a worker may be supported, and a scaffold frame configured to support the walkboard above the ground. The walkboard includes a coupling element projecting downwardly relative to the support surface. The frame includes a pair of spaced apart upright support posts and a ledger coupled to the support posts and extending therebetween to define a longitudinal ledger axis. The ledger includes an outer wall that presents an upper walkboard bearing surface extending along the ledger axis, with the walkboard being supported on the bearing surface. The wall includes a plurality of slot-defining edges that cooperatively present a generally orthogonal shaped slot in which the coupling element is received. The edges include a recessed edge spaced below the bearing surface and extending along the ledger axis. The edges further include a pair of abutment edges spaced along the ledger axis, with the abutment edges projecting substantially perpendicularly from the recessed edge and extending to the bearing surface to generally prevent the walkboard from shifting along the ledger axis when the coupling element engages one of the abutment edges.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

DETAILED DESCRIPTION OF THE PREFERRED EMBODIMENTS

Figure 4:
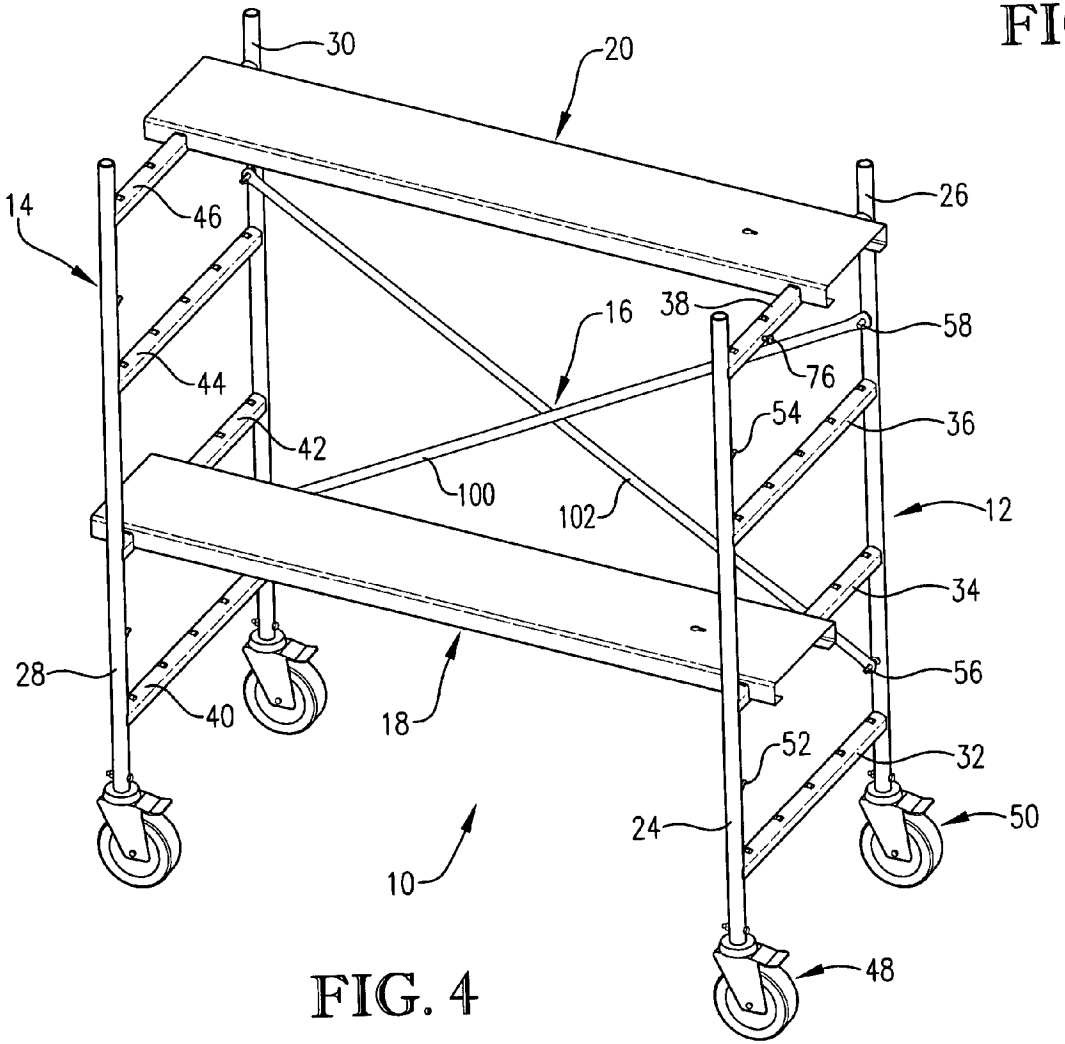
FIG. 4 is a perspective view of scaffolding constructed in accordance with a preferred embodiment of the present invention and including a plurality of open-slotted ledgers for supporting walkboards with a pair of walkboards shown in a stepped arrangement.

FIG. 4 illustrates scaffolding 10 constructed in accordance with a preferred embodiment of the present invention and configured for elevating a worker (not shown) above a floor or ground surface (not shown). The illustrated scaffolding 10 is a mobile (e.g., rollable) and portable (e.g., dimensioned and configured to be lightweight and quickly and easily disassembled for compact storage and transport) scaffolding. However, the principles of the present invention are not limited to this scaffolding configuration and equally apply to virtually any type of scaffolding so long as the scaffolding utilizes some type of walkboard supported by ledgers to elevate a worker. The illustrated scaffolding 10 broadly includes a pair of ladder frames 12 and 14, cross bracing 16 coupling the frames 12,14 together, and a plurality of walkboards 18, 20, and 22 (see FIGS. 4 and 6) removably supported between the frames 12,14.

The frames 12,14 are configured to cooperate to support one or more of the walkboards 18,20,22 elevated above the floor or ground surface at various intervals of elevation. In this regard, each of the frames 12,14 includes a corresponding pair of vertical support posts 24, 26 and 28, 30, respectively, and a plurality of slotted ledgers 32, 34, 36, 38 and 40, 42, 44, 46 coupled to and extending horizontally between the corresponding support posts 24,26 and 28,30, respectively. As will subsequently be described in detail, the ledgers 32,34,36,38 and 40,42,44,46 are vertically spaced at the various intervals of elevation and one or more of the walkboards 18,20,22 can be removably supported between any one of the ledgers in the frame 12 and the complemental ledger in the frame 14. Additionally, as described in detail below, the walkboards 18,20,22 can be horizontally spaced along the supporting ledgers at several selected positions and maintained at the desired position to prevent undesired shifting of the walkboard out of the selected position.

Each of the frames 12,14 are virtually identically configured, therefore, only the frame 12 will be described in detail with the understanding that the frame 14 is similarly constructed. In more detail, each of the vertical support posts 24,26 of the frame 12 are generally cylindrical and tubular in configuration presenting a hollow, generally round shaped cross section. The lower ends of each of the posts 24,26 are open and configured to receive various attachment components, such as a corresponding caster 48 and 50, respectively, as will be subsequently described. The upper end of each of the posts 24,26 is also open and although not illustrated, could be configured with a shaft or a pin-receiving aperture to facilitate receipt of various attachment components (e.g., guard rails, another frame, etc.). For purposes that will subsequently be described, fixed to the inside of each of the posts 24,26 is a pair of coupling pins 52, 54 and 56, 58, respectively. The illustrated posts 24,26 are configured and dimensioned to provide portability to the frame 12. In this regard, the illustrated posts 24,26 are preferably formed out of four foot lengths of one inch diameter fifteen gauge steel tubing. However, the posts 24,26 could be formed of any suitable material having any suitable dimensions.

As previously indicated, the plurality of slotted ledgers 32, 34, 36, 38 are coupled to the support posts 24,26 and extend horizontally therebetween. The ledgers 32,34,36,38 are vertically spaced along the posts 24,26 at stepped intervals of elevation. In this regard, when the scaffolding 10 is assembled, the ledgers 32,34,36,38 can function as rungs to allow the worker to climb up the frame 12 to one or more of the walkboards 18,20,22 supported thereon. In addition, as further detailed below, the stepped configuration of the ledgers 32,34,36,38 enable one or more of the walkboards 18,20,22 to be supported at various intervals of elevation to provide an adjustable work surface. As detailed below, each of the ledgers 32,34,36,38 is configured to support one or more of the walkboards 18,20,22 in a selected position and prevent the supported walkboard from undesired shifting along the supporting ledger. Except as noted below, each of the ledgers 32,34,36,38 is virtually identically configured, therefore, only the ledger 38 will be described in detail with the understanding that the ledgers 32,34,36 are similarly constructed.

Figure 1:
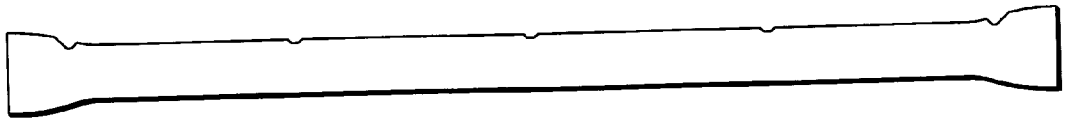
FIG. 1 PRIOR ART
FIG. 1 is a side elevational view of a prior art ledger.
Figure 2:
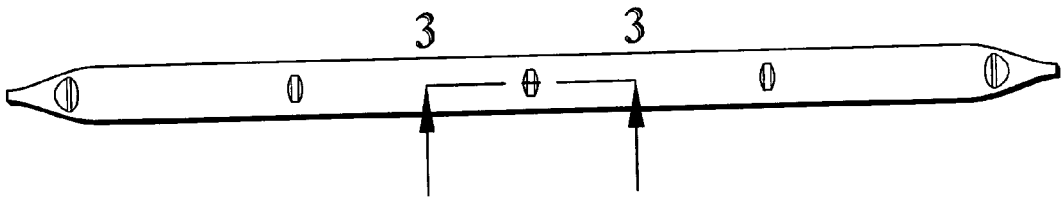
FIG. 2 PRIOR ART
FIG. 2 is a plan view of the prior art ledger shown in FIG. 1.
Figure 3:
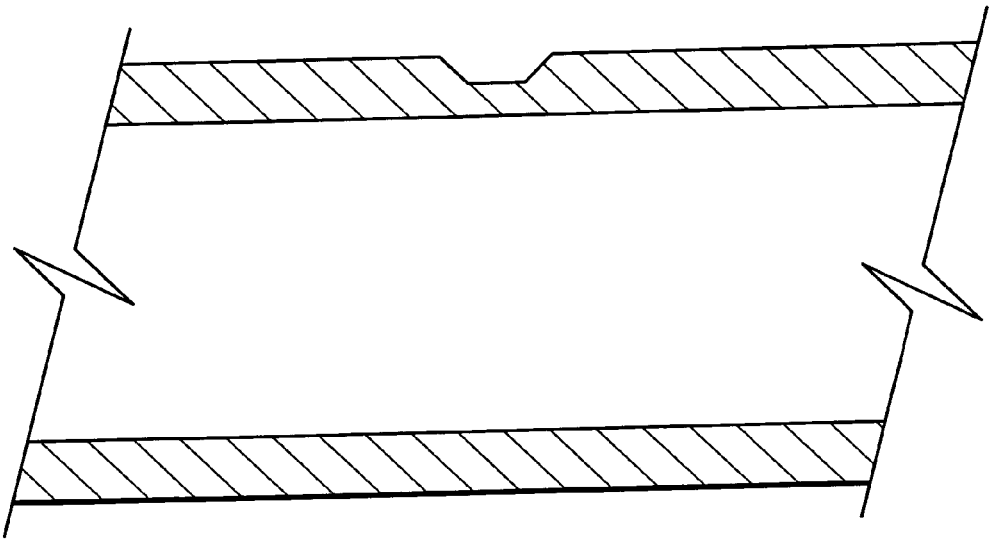
FIG. 3 PRIOR ART
FIG. 3 is sectional view of the prior art ledger taken substantially along line 3—3 of FIG. 2.
Figures 5, 6, 7:
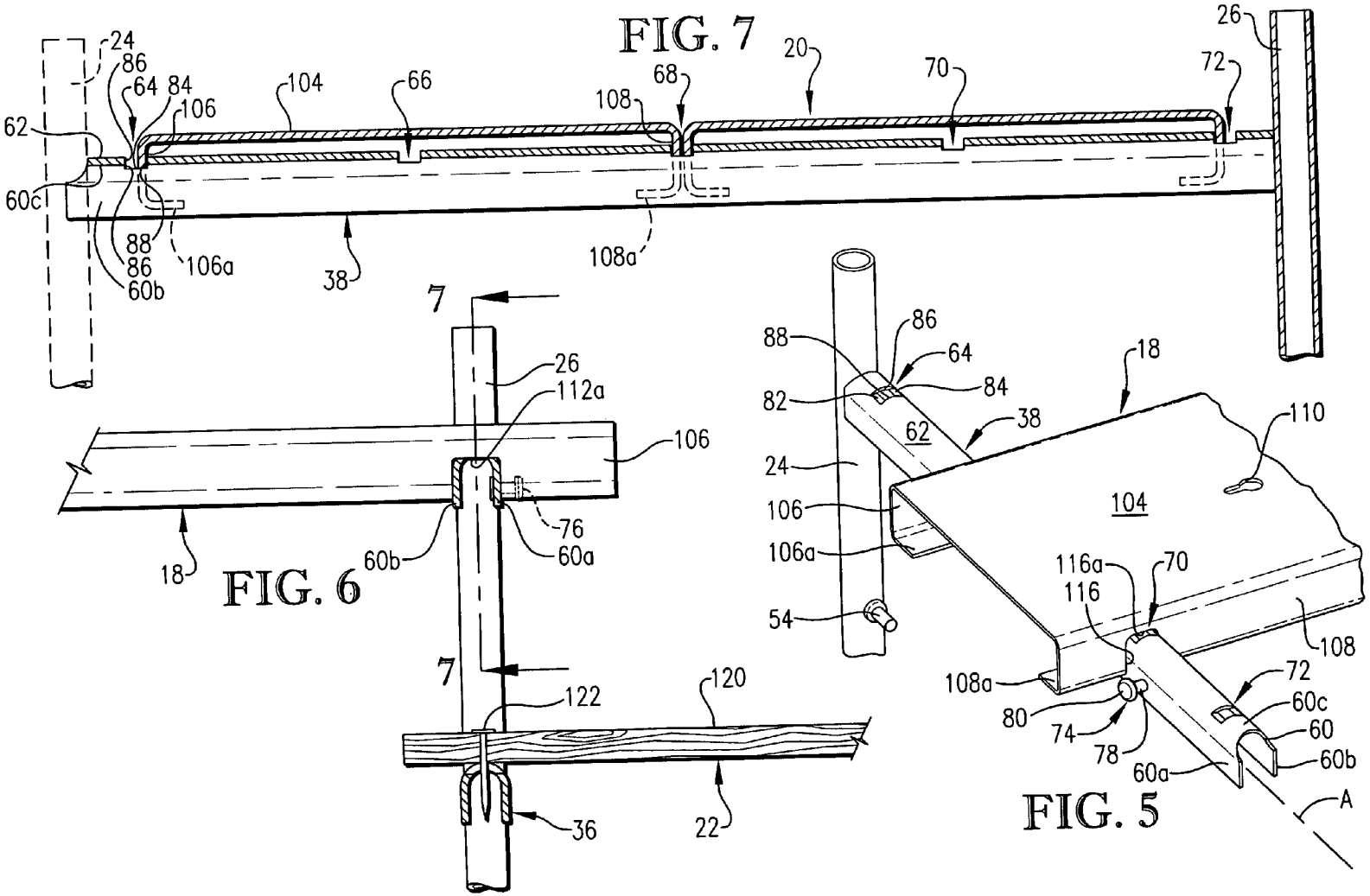
FIG. 5 is a fragmentary enlarged perspective view of the scaffolding shown in FIG. 4 illustrating the slots of one of the ledgers and shown with one walkboard in the center position.
FIG. 6 is a fragmentary enlarged elevational view of the scaffolding shown in FIG. 4 illustrating a wooden walkboard plank coupled to the ledger with an elongated headed fastener extending into one of the slots of one of the ledgers and a pair of metal walkboards coupled to another one of the ledgers.
FIG. 7 is a fragmentary enlarged sectional view of the scaffolding taken substantially along line 7—7 of FIG. 6 illustrating the pair of walkboards in an adjacent relationship on the ledger with one of the support posts shown in phantom.

In more detail, and as shown in FIG. 5, the ledger 38 is defined by a wall 60 that presents a generally inverted U-shaped vertical cross-sectional shape having a hollow interior. The wall 60 extends horizontally to generally define a longitudinal ledger axis (designated as A in FIG. 5). The wall 60 includes a pair of downwardly extending flanges 60*a* and 60*b* interconnected by a web section 60*c*. For purposes that will be subsequently described, the flanges 60*a*,60*b* are spaced on either side of the ledger axis A to define and open bottom along the length of the ledger 38. As will be detailed below, it is important that the web section 60*c* be arcuate to define an arch between the flanges 60*a*,60*b*. The outer surface of the arcuate web section 60*c* presents an upper walkboard bearing surface 62 spaced from and extending along the ledger axis A. The walkboard bearing surface 62 is configured to support one or more of the walkboards 18,20,22. At each end of the ledger 38, the web section 60*c* is cut away (see FIGS. 5 and 7). In this manner, a portion of the cylindrical support posts 24,26 can be received between the flanges 60*a*,60*b*. This enables the ledger 38 to be quickly, effectively and securely attached to the posts 24,26 during assembly. For example, this configuration facilitates a secure weld between the ends of the ledger 38 and the posts 24,26. Such a secure weldment at the ledger ends was difficult, if not impossible, to obtain with the prior art ledgers as illustrated in FIGS. 1–3. As will subsequently be described in detail, a plurality of slots 64, 66, 68, 70, and 72 are defined in, and spaced along, the arcuate web section 60*c* (see FIGS. 5 and 7).

Figure 8:
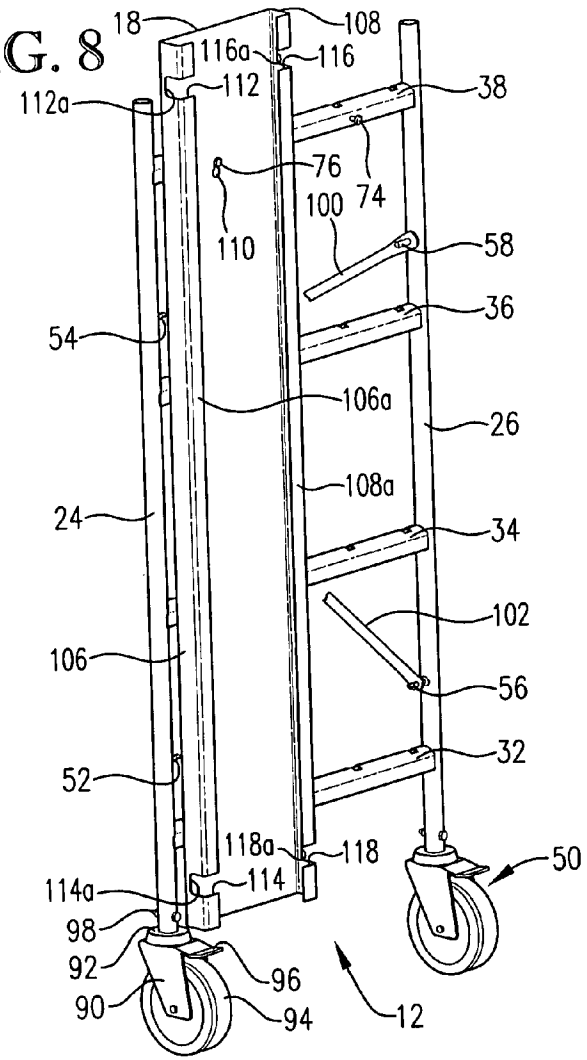
FIG. 8 is a fragmentary perspective view of the scaffolding shown in FIG. 4 illustrating one of the walkboards in the storage position.

The ledger 38 includes a pair of hooks 74 and 76 coupled to and extending from the flange 60*a* (see FIGS. 5 and 8). As will be further detailed below, the hooks 74,76 are each configured to support one of the walkboards 18,20 in a storage position as shown in FIG. 8. The illustrated hooks 74,76 are virtually identically configured, therefore, only the hook 74 will be described in detail, with the understanding that the hook 76 is similarly constructed. The hook 74 includes a shank 78 and a head 80 fixed to the shank 78. The shank 78 extends from the flange 60*a* to space the head 80 from the flange 60*a*. The hooks 74,76 are preferably included on the upper-most ledger to facilitate effective support of walkboards in the storage position, thus in the illustrated frame 12, the ledgers 32,34,36 do not include hooks. However, the hooks could be included on any or all of the ledgers.

As previously indicated, the ledger 38 is configured to prevent undesired shifting of a walkboard supported thereon. Each of the slots 64,66,68,70,72 is configured and dimensioned to receive a portion of the supported walkboard and prevent shifting of the walkboard along the ledger axis A. Each of the slots 64,66,68,70,72 are virtually identical in configuration and thus only the slot 64 will be described in detail with the understanding that the slots 66,68,70,72 are similarly constructed. In more detail, the slot 64 is defined in the web section 60*c* by a plurality of slot-defining edges including a pair of recessed edges 82 and 84 and a pair of abutment edges 86 and 88 (see FIGS. 5 and 7). Each of the recessed edges 82,84 are spaced below the bearing surface 62 and extend along, generally parallel to, the ledger axis A. Each of the abutment edges 86,88 project substantially perpendicularly from each of the recessed edges 82,84 to present a generally orthogonal shape for the slot 64. Each of the abutment edges 86,88 extends vertically to the bearing surface 62 so that each of the abutment edges 86,88 is substantially perpendicular to the ledger axis A. As previously indicated, the web 60*c* is arcuate presenting an arch between the flanges 60*a*,60*b*. This arcuate configuration cooperates with the recessed nature of the edges 82,84 and the perpendicular alignment of the edges 86,88 to provide a prominent and secure abutment surface along each of the abutment edges 86,88. As will be subsequently detailed below, the abutment surfaces engage a portion of a walkboard supported on the ledger 38 to prevent undesired shifting of the supported walkboard along the ledger axis A. For purposes that will be further described below, the slot 64 is open between the edges 82,84,86,88 and communicates with the hollow interior of the ledger 38 and the open bottom defined between the flanges 60*a*,60*b*. In this regard, the open slot 64 allows materials to pass from the bearing surface 62 through the ledger and drain out the open bottom thereof. For example, during assembly, exterior paint does not gather in the slot and thus does not inhibit the function of the abutment surfaces. Furthermore, debris that might otherwise accumulate on the bearing surface 62 (e.g., joint compound, putty, mud, etc.) can drain through the ledger 38 and out the open bottom thereof rather than collecting in the slot 64 as was problematic in the prior art of FIGS. 1–3.

The frame 12 is a mobile scaffolding frame and includes the previously indicated casters 48,50. The casters 48,50 are virtually identically configured and therefore only the caster 48 will be described in detail with the understanding that the caster 50 is similarly constructed. The caster 48 is swively received in the open lower end of the post 24 of the frame 12. In one manner known in the art, the caster 48 includes a caster housing 90, a stub shaft 92 swively coupled to the housing 90, a wheel 94 rollably supported in the housing 90, and a foot brake 96 operable to selectively prevent the wheel 94 from rolling. The caster housing 90 supports the post 24 on the wheel 94. The stub shaft 92 is removably received in the open lower end of the post 24 and is configured to be locked in the post 24. For example, the illustrated shaft 92 includes an aperture (not shown) that aligns with apertures formed in the lower end of the post 24. In this manner, a retaining pin 98 can be inserted through the post 24 and the stub shaft 92 to retain the shaft in the lower end of the post 24. The stub shaft 92 includes a bearing ring formed in its lower end that carries a bearing (not shown) to allow the caster housing 90 and thus the wheel 94 to swivel relative to the stub shaft 92 while still supporting the weight of the frame 12. The foot brake 96 can be pivoted into and out of a locking position (not shown) wherein the brake 96 communicates with the wheel 94 to prevent the wheel 94 from rolling. It is within the ambit of the present invention to utilize various alternatively configured means for providing mobility to the scaffolding 10 that can be selectively prevented. One such suitable alternative is the braking system disclosed in pending application for U.S. Letters patent Ser. No. 10/271,634, filed Oct. 15, 2002, entitled MOBILE SCAFFOLDING BRAKE (sharing a common inventor with the present application), which is hereby incorporated by reference herein as is necessary for a full and complete understanding of the present invention.

As previously indicated, the frame 12 is a lightweight portable scaffolding frame (e.g., formed of 15 gauge steel tubing having a one inch diameter and being four foot in length). However, the principles of the present invention could be applied to virtually any type of scaffolding frame and are not limited to mobile, portable type frames. For example, various suitable alternative frames are disclosed in pending application for U.S. Letters patent Ser. No. 09/967,733, filed Sep. 29, 2001, entitled MULTIPURPOSE FRAME ASSEMBLY (sharing a common inventor with the present application), which is hereby incorporated by reference herein as is necessary for a full and complete understanding of the present invention.

As indicated above, the frame 14 is configured in a manner similar to the frame 12 detailed above. The illustrated frames 12,14 are removably coupled together by the cross bracing 16. Particularly, in one manner known in the art, the bracing 16 is a scissor-type brace including a pair of pivotally connected rods 100 and 102 (see FIG. 4). The rods 100,102 pivot relative to each other to provide adjustability of the horizontal spacing of the frames 12,14. The ends of each of the rods 100,102 are configured to be removably received on the pins 52,54 and 56,58 of the posts 26,30, respectively. The pins 52,54,56,58 preferably include some type of safety locking device to prevent the rods from inadvertently sliding off the pins. There are several types of such locking devices known in the art. For example, various suitable locking devices are disclosed in U.S. Pat. No. 6,471,003, issued Oct. 29, 2002, entitled UTILITY SCAFFOLDING HAVING SAFETY FEATURES (sharing a common inventor with the present application), which is hereby incorporated by reference herein as is necessary for a full and complete understanding of the present invention. The illustrated scaffolding 10 preferably includes bracing on one side only to enable a worker open access to the walkboards supported on the scaffolding from the other side. Accordingly, the cross bracing 16 is coupled to the vertical posts 26 and 30. However, it is within the ambit of the present invention to utilize various alternatives for coupling the frames 12,14. For example, the frames could be joined with cross bracing on each side of the scaffolding. Additionally, the frames could be joined with a nonremovable and/or folding support bracing as is known in the art.

As previously indicated, the frames 12,14 cooperate to support one or more of the walkboards 18,20,22 elevated above the floor or ground surface at various intervals of elevation. The walkboards 18,20,22 are configured to be removably supported between any one of the ledgers in the frame 12 and the complemental ledger in the frame 14. The walkboards 18,20,22 can be horizontally spaced along the supporting ledgers at one of several positions and maintained at the desired position to prevent undesired shifting of the walkboard out of the selected position. The walkboards 18 and 20 are virtually identical in configuration and thus only the walkboard 18 will be described in detail with the understanding that the walkboard 20 is similarly constructed. The walkboard 22 is somewhat different in configuration and will be described separately below.

In more detail, and as shown in FIGS. 4–8, the illustrated walkboard 18 is a formed metal-type walkboard integrally formed from a single sheet of material (e.g., aluminum, steel, etc.) presenting a support surface 104 and a pair of sidewalls 106 and 108 extending from the support surface. The support surface 104 is configured and dimensioned to support the worker above the floor or ground surface when the walkboard 18 is supported horizontally between the frames 12,14. The illustrated support surface 104 includes a keyhole 110 formed in the surface 104 adjacent one end. The keyhole 110 is configured and dimensioned to receive one of the hooks 74,76 when the walkboard 18 is in a storage position as illustrated in FIG. 8. Particularly, the head 80 of the hook 74 is received through the keyhole 110 so that the walkboard 18 hangs on the shank 78 of the hook 74. In this manner, the walkboard 18 can be conveniently stored on the scaffolding 10 in a quickly accessible manner when the walkboard 18 is not in use. The sidewalls 106,108 extend vertically downward from the support surface 104 and each include a bottom rail 106*a* and 108*a*, respectively. The rails 106*a*,108*a* provide a smooth bottom surface free from sharp edges and corners exposed on the exterior of the walkboard 18.

As shown in FIG. 5, the walkboard 18 is not as wide as the ledger 38 and in fact can be placed in several different positions along the ledger 38. Accordingly, as indicated above, the walkboard 18 includes structure that engages one or more of the slots in the supporting ledgers to prevent the walkboard 18 from undesired shifting of the walkboard 18 along the ledger axis A and out of the selected position. In the illustrated walkboard 18, this structure includes a pair of coupling margins 112 and 114 formed by cutouts in the sidewall 106, a pair of coupling margins 116 and 118 formed by cutouts in the sidewall 108, and portions of the vertical sidewalls 106 and 108 adjacent the cutouts. In more detail, each of the margins 112,114,116,118 is configured to receive the web section 60*c* and at least a portion of the flanges 60*a*,60*b* therein when the walkboard 18 is supported on the ledger 38. In the illustrated sidewalls 106,108 the margins 112,114,116,118 are formed in the vertical portion of the sidewalls 106,108 and in the rail portions 106*a*,108*a*. The margins 112,114,116,118 each include a horizontal ridge 112*a*, 114*a*, 116*a*, and 118*a*, respectively (see FIG. 8), that is formed in the vertical portion of the corresponding sidewall 106,108 and that extends generally parallel to the support surface 104. As shown in FIG. 7, the illustrated slots 64,66,68,70,72 are spaced along the ledger 38 so that each slot is spaced from at least one other slot the width dimension of the walkboard 18. In the illustrated ledger 38, the middle slot 68 is spaced from each of the end slots 64,72 the width of the walkboard 18 and the slots 66,70 are spaced apart the width of the walkboard 18. In this manner, when the walkboard 18 is supported on the ledger 38 and the web section 60*c* is received in the corresponding margins 112, 116, the ridges 112*a*,116*a* each engage the recessed edges of one of the slots (e.g., the slots 66 and 70 in FIG. 5 and the slots 64 and 68 in FIGS. 6 and 7). When the ridges 112*a*,116*a* engage the recessed edges of the corresponding slots, the inside and outside surfaces of the vertical portion of the corresponding sidewall 106,108 that is adjacent the ridges 112*a*,116*a* (e.g., the portion of the sidewall 106 or 108 just above the ridge) engages one of the abutment edges of the corresponding slot to prevent shifting of the walkboard 18 along the ledger axis A of the ledger 38. For example, as shown in FIGS. 6 and 7, the inside surface of the vertical portion of the sidewall 106 engages the abutment edge 88 of the slot 64 to prevent the walkboard 18 from shifting along the ledger axis A toward the vertical post 26. In a similar manner, shifting of the walkboard 18 toward the vertical post 24 is prevented by engagement of the inside surface of the sidewall 108 and the abutment edge of the slot 68.

As shown in FIG. 7, the sidewalls 106,108 of the walkboard 18 and the slots 64,66,68,70,72 are complementally configured and dimensioned so that two walkboard sidewalls can be received in a single slot (e.g., in the middle slot 68 when two walkboards are supported adjacent one another on the same ledger). It is preferred that the abutment edges (e.g., the edges 86,88) orthogonally engage as much of the sidewall of the walkboard 18 as feasible to optimize the shift prevention function. Accordingly, in the illustrated scaffolding 10, the ridges 112*a*,114*a*,116*a*,118*a* engage the recessed edges of the slots and thereby support the weight of the walkboard 18. Additionally, the arcuate web section 60*c* is arched sufficiently to facilitate a deeper abutment edge (e.g., preferably greater than one-eighth inch recess from the bearing surface 62). In this manner, when a worker applies pressure to the walkboard 18, the walkboard does not "jump" the abutment edge and fall out of the slot allowing undesired shifting of the walkboard along the ledger, as was problematic with the prior art illustrated in FIGS. 1–3. In the illustrated scaffolding 10, the margins 112*a*,114*a*,116*a*,118*a* also are configured to engage a portion of the flanges 60*a*,60*b* to prevent shifting of the walkboard perpendicular to the ledger axis A.

It is within the ambit of the present invention to utilize variously configured walkboards having alternative coupling structure between the walkboard and the slotted ledger. For example, the walkboard sidewalls do not need to engage the recessed edges of the slots, but rather the walkboard could be supported on the bearing surface of the ledger as long as a portion of the sidewall extends below the bearing surface sufficiently to engage a portion of the abutment edges. Additionally, the sidewalls do not need to be able to engage the flanges of the ledger. However, it is important that the walkboard include some structure operable to cooperate with the slot to prevent undesired shifting of the walkboard along the ledger.

One example of a suitable alternatively configured walkboard is the walkboard 22 as shown in FIG. 6. The walkboard 22 comprises a wooden plank-type walkboard presenting a support surface 120 configured and dimensioned to support the worker above the floor or ground surface when the walkboard 22 is supported horizontally between the frames 12,14. Unlike the previously described walkboards 18,20, the walkboard 22 is fully supported on the bearing surface of the respective ledgers. The walkboard 22, like the walkboard 18,20, is not as wide as the ledgers and thus can be positioned in various horizontal locations along the ledgers and thus includes structure to prevent undesired shifting along the ledger and out of the selected position. In the walkboard 22 this structure includes a headed fastener 122 having a shank that extends below the support surface 120 and into one of the open slots in the supporting ledger. In this manner, the shank can engage one of the abutment edges of the slot to prevent shifting of the walkboard 22 along the ledger axis A. The open slots enable the headed fastener 122 to extend into the hollow interior of the supporting ledger, facilitating a variety of applications. In this regard, the fastener 122 could be inserted into the walkboard 22 so that the headed portion extends out of the open side of the ledger between the flanges. In this manner, after the fastener 122 is inserted into the walkboard 22, the headed portion of the fastener 122 could be bent into engagement with either of the flanges or the underside of the web inside the hollow interior of the ledger to also prevent vertical shifting of the walkboard off of the ledger. Additionally, the open slots and open sided ledger facilitate the use of fasteners of various types and dimensions to prevent the walkboard 22 from shifting along the ledger. For example, the fastener could comprise a bolt-type fastener that extends through the walkboard and one of the slots in the ledger to receive a washer (e.g., against the flanges or the web) and a nut to secure the walkboard to the ledger in a more permanent manner (e.g., for applications wherein the scaffolding may be set up for longer periods of time, etc.).

In use, the scaffolding 10 is assembled by interconnecting the frames 12,14 with the cross bracing 16 and then supporting one or more of the walkboards 18,20,22 in the desired position. During use, one or more of the walkboards 18,20,22 can be quickly and easily repositioned to accommodate a wide variety of applications. For example, as shown in FIG. 4, the walkboards 18,20 can be positioned in a step configuration to provide a multi-level support surface. In this application, an outside and a middle slot receive the walkboard sidewalls to prevent the walkboard from shifting out of the desired position. As shown in FIG. 5, a single one of the walkboards 18,20,22 can be utilized in a middle position (e.g., supported in slots 66,70 of ledger 38). As shown in FIG. 7, the walkboards 18,20 can be placed side-by-side on the same ledger (e.g., ledger 38) wherein the middle slot 68 receives one sidewall from each walkboard. As shown in FIG. 6, the walkboard 22 can be used end-to-end with another walkboard on adjacent ledgers (e.g., to span between frames of adjacent scaffolding sections, etc.). As shown in FIG. 8, when a walkboard (e.g. the walkboard 18) is not in use, the walkboard can be placed in the storage position on the scaffolding 10 where it is out of the way, yet easily accessible.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. Scaffolding for supporting a worker elevated above the ground, said scaffolding comprising:

a walkboard presenting a support surface on which the worker may be supported, said walkboard including a horizontally extending plank including a pair of opposite ends and presenting said support surfaces, said walkboard further including at least one flange that is coupled to the plank and extends lengthwise between the ends, said flange including at least a portion thereof extending vertically from the plank; and a scaffold frame configured to support the walkboard above the ground, said frame including a pair of spaced apart upright support posts, said frame further including a ledger coupled to the support posts and extending therebetween to define a longitudinal ledger axis, said ledger including an outer wall that presents an arcuate upper surface extending along the ledger axis, said wall including a plurality of slot-defining edges that cooperatively present a generally orthogonal shaped slot in which the flange is received, said support surface extending beyond both sides of the ledger when the flange is received in the slot, said edges including a pair of recessed edges spaced below the upper surface and extending along the ledger axis, said flange resting on and being supported by the recessed edges, said plank being spaced from the recessed edges when the flange is received in the slot, said edges further including a pair of abutment edges spaced along the ledger axis, with the abutment edges projecting substantially perpendicularly between the recessed edges and extending to the upper surface to generally prevent the walkboard from shifting along the ledger axis when the flange engages one of the abutment edges.

2. The scaffolding as claimed in claim 1, said outer wall extending about the ledger axis to define a generally hollow interior of the ledger, said slot defining an opening between the plurality of slot-defining edges, said opening communicating with the hollow interior of the ledger.

3. The scaffolding as claimed in claim 2, said outer wall having a generally inverted U-shaped cross-section relative to the ledger axis, such that the outer wall includes a substantially horizontal web section and a pair of depending substantially vertical sidewalls, said upper surface being defined by the web section, said outer wall presenting a bottom drain opening defined between the sidewalls, said drain opening being spaced below the upper surface and communicating with the hollow interior of the ledger.

4. The scaffolding as claimed in claim 3, each of said support posts being cylindrical so as to define a generally circular horizontal cross sectional shape, said outer wall being configured so that each support post is at least partially received between the sidewalls.

5. The scaffolding as claimed in claim 1, said recessed edges being spaced on either side of the ledger axis.

6. The scaffolding as claimed in claim 1, said walkboard including an additional flange coupled to the plank and horizontally spaced from the first-mentioned flange, said additional flange including at least a portion thereof extending vertically from the plank.

7. The scaffolding as claimed in claim 6, said wall including an additional plurality of slot-defining edges that cooperatively present an additional generally orthogonal shaped slot in which the additional flange is received.

8. The scaffolding as claimed in claim 7, said additional slot being configured substantially like said first-mentioned slot and being horizontally spaced therefrom.

9. The scaffolding as claimed in claim 1, said recessed edges being substantially flat and parallel to one another and the ledger axis.

10. The scaffolding as claimed in claim 9, said recessed edges being generally coplanar.

11. The scaffolding as claimed in claim 1, shifting of the walkboard along the ledger axis being prevented in a first direction when said flange engages a first one of the abutment edges, shifting of the walkboard along the ledger axis being prevented in a second direction opposite the first direction when said flange engages the other abutment edges, said first and second directions each being generally parallel to said ledger axis wherein the walkboard is free to shift relative to the ledger axis in a third direction, said third direction being nonparallel and non-coplanar to the first and second directions.

12. Scaffolding for supporting a worker elevated above the ground, said scaffolding comprising:

a walkboard presenting a support surface on which the worker may be supported, said walkboard including a horizontally extending plank including a pair of opposite ends and presenting said support surface, said walkboard further including at least one flange that is coupled to the plank and extends lengthwise between the ends, said flange including at least a portion thereof extending vertically from the plank; and a scaffold frame configured to support the walkboard above the ground, said frame including a pair of spaced apart upright support posts, said frame further including a ledger coupled to the support posts and extending therebetween to define a longitudinal ledger axis, said ledger including an outer wall that presents an arcuate upper surface extending along the ledger axis, said wall including a plurality of slot-defining edges that cooperatively present a generally orthogonal shaped flange-receiving slot, said support surface extending beyond both sides of the ledger, said edges including a pair of recessed edges spaced below the upper surface and extending along the ledger axis, said plank being spaced from the recessed edges, said edges further including a pair of abutment edges spaced along the ledger axis, with each of the abutment edges projecting substantially perpendicularly between the recessed edges and extending along a substantially vertical plane to the upper surface, said flange being received in the slot and engaging the abutment edges to generally prevent the walkboard from shifting along the ledger axis.

13. The scaffolding as claimed in claim 12, said outer wall extending about the ledger axis to define a generally hollow interior of the ledger, said slot defining an opening between the plurality of slot-defining edges, said opening communicating with the hollow interior of the ledger.

14. The scaffolding as claimed in claim 13, said outer wall having a generally inverted U-shaped cross-section relative to the ledger axis, such that the outer wall includes a substantially horizontal web section and a pair of depending substantially vertical sidewalls, said upper surface being defined by the web section, said outer wall presenting a bottom drain opening defined between the sidewalls, said drain opening being spaced below the upper surface and communicating with the hollow interior of the ledger.

15. The scaffolding as claimed in claim 12, said walkboard including an additional flange coupled to the plank and horizontally spaced from the first-mentioned flange, said additional flange including at least a portion thereof extending vertically from the plank.

16. The scaffolding as claimed in claim 15, said wall including an additional plurality of slot-defining edges that cooperatively present an additional generally orthogonal shaped slot in which the additional flange is received.

17. The scaffolding as claimed in claim 16, said additional slot being configured substantially like said first-mentioned slot and being horizontally spaced therefrom.

18. The scaffolding as claimed in claim 12, said recessed edges being substantially flat and parallel to one another and the ledger axis.

19. The scaffolding as claimed in claim 18, said recessed edges being generally coplanar.

20. The scaffolding as claimed in claim 12, shifting of the walkboard along the ledger axis being prevented in a first direction when said flange engages a first one of the abutment edges, shifting of the walkboard along the ledger axis being prevented in a second direction opposite the first direction when said flange engages the other abutment edge, said first and second directions each being generally parallel to said ledger axis wherein the walkboard is free to shift relative to the ledger axis in a third direction, said third direction being nonparallel and non-coplanar to the first and second directions.

* * * * *